US006482137B2

(12) United States Patent
Walker

(10) Patent No.: US 6,482,137 B2
(45) Date of Patent: Nov. 19, 2002

(54) INERTIA EXERCISE MACHINE

(76) Inventor: Brett C. Walker, 524 W. Vintage Dr., Provo, UT (US) 84604

( * ) Notice: Subject to any disclaimer, the term of this patent is extended or adjusted under 35 U.S.C. 154(b) by 0 days.

(21) Appl. No.: 09/726,815

(22) Filed: Nov. 30, 2000

(65) Prior Publication Data

US 2002/0065175 A1 May 30, 2002

(51) Int. Cl.[7] ..... A63H 1/32
(52) U.S. Cl. ..... 482/110; 446/254
(58) Field of Search ..... 446/253, 254; 482/110, 92; D21/463

(56) References Cited

U.S. PATENT DOCUMENTS 766,743 A 8/1904 Terry
D193,012 S * 6/1962 Agrillo ..... D21/463
3,069,162 A 12/1962 Samuel ..... 272/79
4,552,542 A * 11/1985 Reysman ..... 446/254
5,226,867 A 7/1993 Beal ..... 482/127
5,267,921 A 12/1993 Roehlk ..... 482/44
5,399,136 A * 3/1995 Bart ..... 482/110
5,490,817 A 2/1996 Stander et al. ..... 482/46
5,507,712 A 4/1996 Chang ..... 482/126
5,569,125 A 10/1996 Clementi ..... 482/46
5,643,158 A 7/1997 Clementi ..... 482/121
5,648,161 A 7/1997 Miyazawa et al. ..... 428/332
5,967,953 A 10/1999 Nunez ..... 482/121

* cited by examiner

*Primary Examiner*—Glenn E. Richman
(74) *Attorney, Agent, or Firm*—Todd E. Zenger; Kirton & McConkie

(57) ABSTRACT

A spinning exercise device manipulated by the user and to which weights may be added to increase the level of exercise of the user.

8 Claims, 6 Drawing Sheets

INERTIA EXERCISE MACHINE

BACKGROUND

1. Field of the Invention

The present invention relates to an exercise device. More particularly, the present invention is directed to an exercise device employing a spinning disk, tethers attached thereto such that the spinning of the disk winds the tethers drawing the ends of the tethers toward the disk with a certain force. With tethers wound, the user, exerting force to extend the tethers in a direction away from the disk, causes the disk to spin in an opposite direction which causes the tethers to wind again, again drawing the ends of the tethers toward the spinning disk. This repeated lengthening and shortening of the tethers and the corresponding inertia provides an exercise regimen for the user.

2. Background Art

It has been known for hundreds of years to thread a button through a loop of string, spin the button and thereafter keeping the button spinning by drawing the ends of the loop of string inward and outward. This children's game is known.

U.S. Pat. No. 3,069,162 discloses an exercise device consisting of an inflatable ball and a plurality of loop assemblies fixed on opposite sides thereof. Each of a pair of pull ropes is threaded through a series of loops thereby disposing one pull rope on each of the opposite sides of the ball. The pair of pull ropes are connected to a pair of pull bars through laterally spaced apertures therein. The ball is configured so that it may be placed closer to one handle than the other. The device is designed for the use by two people pulling in opposite directions. The known prior art is not designed for use by a single individual or designed to permit the user to select varying degrees of difficulty or resistance when using the device.

What is needed is a light weight spinning exercise device. In addition, what is needed is a spinning exercise device which is designed for a single user. Furthermore, what is needed is a device the resistance or exercise level of which the user can selectively and personally determine by easily, readily, and removably adding weight to the spinning disk to increase or decrease inertial forces associated with use of the spinning disk exercise device.

SUMMARY OF THE INVENTION

An object of the present invention is to provide an exercise device, which can be readily manipulated by one or more hand or foot of a single user or by having one end attached to a stationary device.

A further object of the present invention is to provide a light weight exercise device using inertial resistance wherein the weight of the spinning body can be readily increased or decreased to respectively increase or decrease the level of exercise of the user. These and other objects are met by the present invention.

The present invention is directed to a spinning disk exercise device. The spinning exercise device comprises a disk and associated tethers. The disk of the present invention is configured and disposed so as to receive two or more tethers on opposing sides of the disk. The tethers are wound or coiled upon the spinning of the disk. The coiling of the tethers shortens the length of the tethers and resists the spinning of the disk until the disk is slowed to a stop and whereupon the disk begins spinning in the opposite direction to unwind or uncoil the tethers. If the user exerts outward force upon the tethers away from the disk, the uncoiling of the tethers and spinning of the disk are accelerated. The spinning of the disk accelerates in the new direction until the winding of the tethers is undone and the tethers begin to be wound in the opposite direction again resisting the spinning of the disk until the disk comes to a stop and begins spinning again in the opposite direction. This is repeated over and over. As the disk spins and the tethers are wound or coiled, the length of the tethers decreases and the ends of the tether not attached to the disk are drawn inward.

The user may derive exercise from using the device by resisting the force shortening the length of the tethers as the tethers are wound by the spinning disk and by exerting outward force against the tethers to slow or reverse the spin of the disk or to accelerate the spin of the disk to unwind the tethers.

The disk is also disposed to receive additional weight such that the momentum of the spinning disk may be increased or decreased to suit the exercise level of the user.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

Similar reference characters illustrate corresponding features in alternative embodiments.

DETAILED DESCRIPTION OF THE PREFERRED EMBODIMENTS

Figure 1:
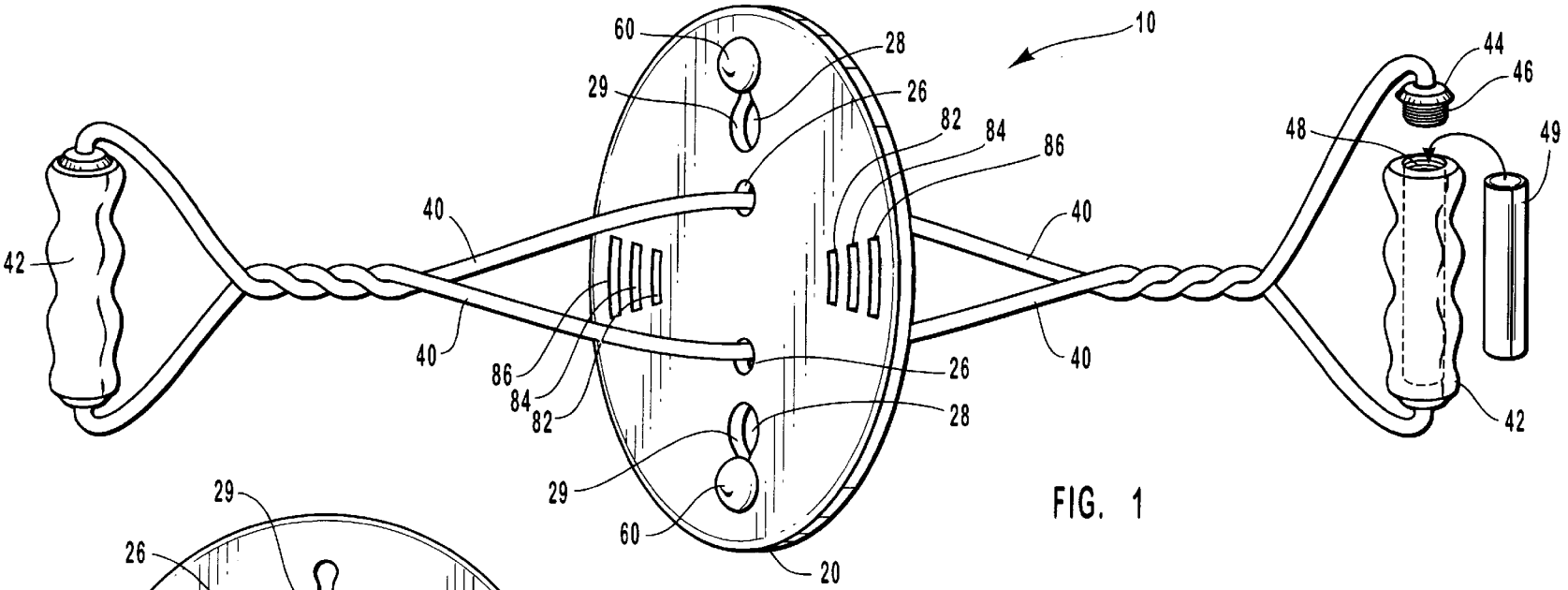
FIG. 1 is a perspective view of one embodiment of the spinning exercise device.

It will be readily understood that the components of the present invention, as generally described and illustrated in the figures herein, could be arranged and designed in a wide variety of different configurations. Thus, the following more detailed description of the embodiments of the system and method of the present invention, and represented in FIGS. 1 through 8, is not intended to limit the scope of the invention, as claimed, but is merely illustrative of some possible embodiments of the invention. The presently preferred embodiments of the invention will be best understood by reference to the drawings, wherein like parts are designated by like numerals throughout.

As shown in the Figures, the spinning exercise device 10 comprises a disk 20, tethers 40, and weights 60. Disk 20 comprises body 22. Preferably body 22 comprises a disk-shaped body 22 having a circumferential portion 24. In one embodiment, body 22 defines two or more apertures 26 equally spaced in a radial direction from the center of body 22 and equally spaced circumferentially about the center point of body 22.

In one embodiment of the present invention, body 22 also defines bays 28. Bay 28 is a lobed opening in body 22. As shown in FIGS. 1–3B, bay 28 comprises a bulbous end 29 transitioning into a narrow necked opening 30 and further extending into an opening 31, opening 31 having a circumferential span larger than the circumferential span of neck opening 30.

Disk 20 is preferably circular in shape so that its center of mass is at the mid point. Nevertheless, disk 20 could be configured to any balanced body or geometric shape, i.e. having an identifiable center of mass about which apertures 26, bay 28 and weights 60, mentioned later, may be radially and equidistantly and circumferentially disposed without impeding or interfering with a balanced spin of disk 20. The disk can be configured from wood, metal, plastic, rubber, or even a ceramic material. Apertures 26 and bays 28 can be drilled, machined, or cast so long as they are equidistance from and symmetric about the center point of disk 20.

Tethers 40 interface with disk 20. One means for interfacing tethers to disk 20 is shown in FIGS. 1–4A wherein tethers 40 pass through apertures 26 in disk 20. The distal ends of tethers 40 may be a loop of cord whose ends are connected within an optional handle 42. Tethers 40 may comprise two separate pieces, the respective opposing distal ends of which are anchored in an optional handle 42. The figures illustrate two tethers 40 on each side of disk 20. However, any plurality of tethers could be used. In an alternative embodiment, another means for interfacing tethers 40 with disk 20 comprises affixing proximal ends of tethers 42 to respective sides of disk 20 as illustrated in FIG. 5. The tethers may be constructed of nylon, plastic, polymers, other manmade materials, rubber, leather, or natural materials such as hemp, sisal, and the like. The tethers may be of a wound, braided, or woven configuration. A principal characteristic of the tethers is that they are substantially inelastic. The substantially inelastic nature serves the purpose of providing inertial resistance against the spinning disk. That is, the winding or coiling of the tethers impedes the spinning of the disk and the unwinding and uncoiling of the tethers accelerates the spinning of the disk 20. While elastic tethers have been used, tethers having an elastic nature dampen the impedance or acceleration of the spinning disk by tethers 40.

Optional handles 42 may be of a variety of construction. They may be as shown in FIG. 1 with an ergonomic profile to enhance gripping and handling by the user. Handles 42 may be made of padded materials such as rubber, foam rubber, or any other padded material providing comfort to the user. Handles 42 could also be merely a loop of a nylon strap or simply a loop or a joined end of tether 42 (not shown). Similarly, handles 42 can be provided with means for readily adjusting the size of handle 42 or the length of tether 40 to accommodate the hand, wrist, leg, or any other desired stationary object intended to anchor one or more ends of the exercise device 10. Handles can be made of any number of materials, including wood, metal, plastic, rubber, fabric, or leather.

In one embodiment shown in FIG. 1, handle 42 comprising a base portion 42 and a cap portion 44 and means for joining base portion 42 and cap portion 44. For example, base portion 42 defines a cavity 48 having a threaded region near the opening of the cavity. The cap portion 44 comprises as threaded stem 26 corresponding to the threaded region of cavity 28. In use cap portion 44 may be removably attached to base portion 42 by mating threads 46 and 48. Cavity 48 is configured to receive weight 49. In one embodiment of the invention a plurality of weights 49 weighing different amounts may be provided to permit the user to select the weight, if any, inserted into cavity 48 of handle 42. Alternative means for joining base portion 42 to cap portion 44 could include snap-fit arrangements or any other attaching mechanism permitting ready attachment and removal of cap portion 44. Furthermore, cavity 48 could be filled with sand, water or any other suitable substance.

Figure 3A:
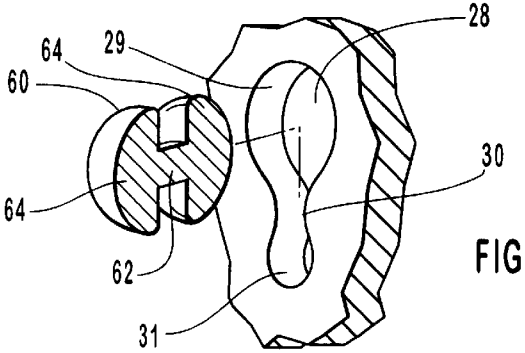
FIGS. 3A and 3B are further views of the embodiment of FIG. 3 illustrating one means for securing weights to the disk.
Figure 2:
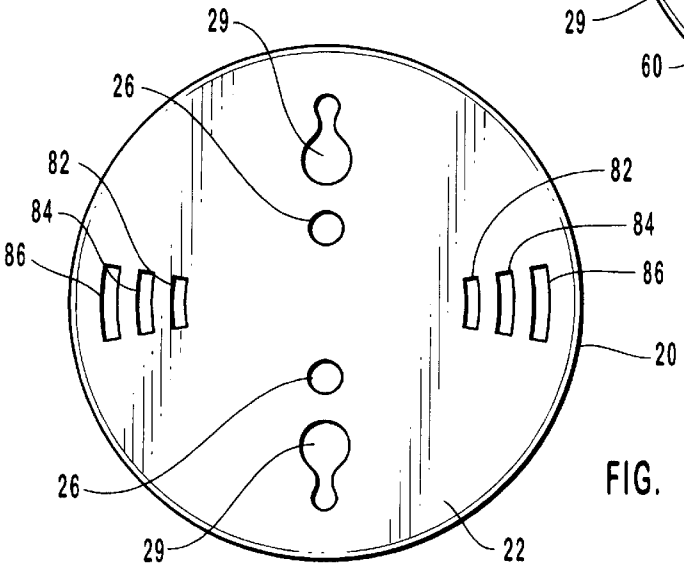
FIG. 2 is a side view of the disk of FIG. 1.
Figure 3:
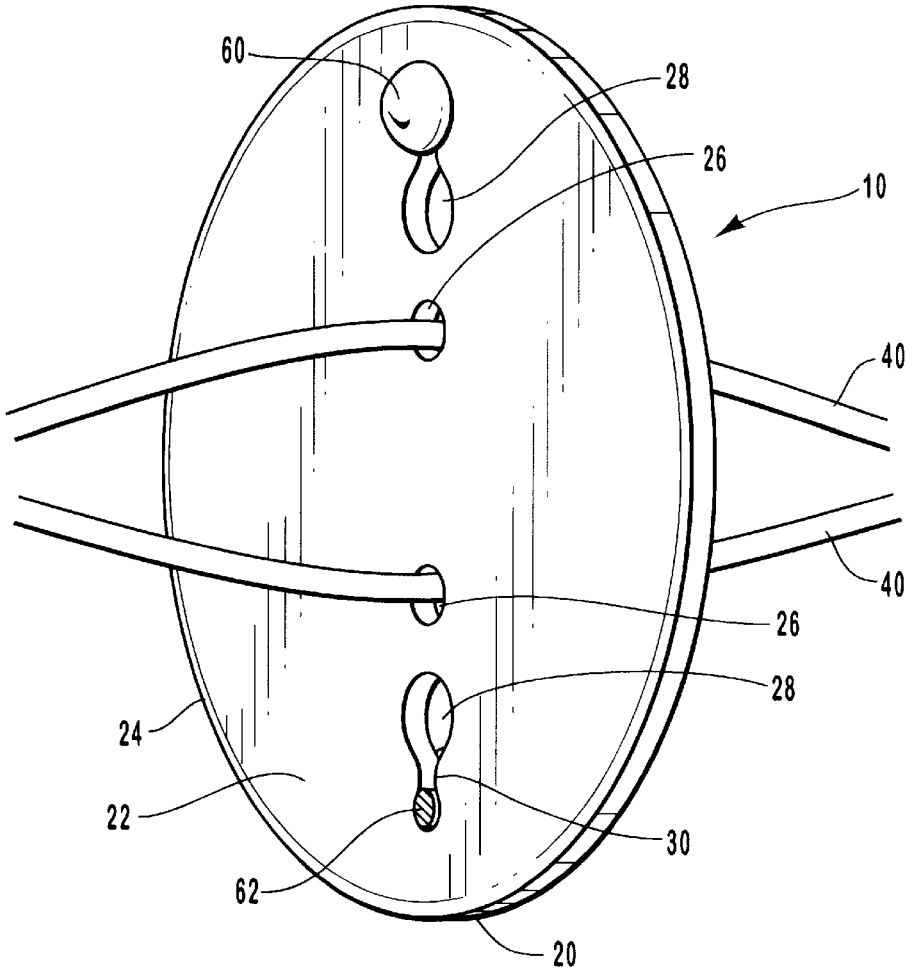
FIG. 3 is a partial sectional view of FIG. 1 illustrating one means for securing weights to the disk.
Figure 3B:
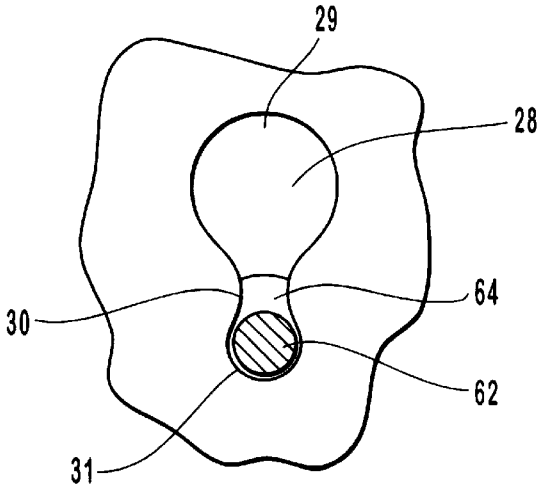

Weights 60 interface with disk 20. As shown in FIGS. 1–3A, weights 60 are disposed in opening 31 of bay 28. As shown in the sectional views of FIGS. 3, 3A and 3B, weight 60 has bulbous opposing sides 64 connected by a post or neck 62. As illustrated in the embodiment of FIGS. 3, 3A and 3B, the cross-sectional area of neck 62 is slightly larger than the cross-sectional area of necked opening 30 of bay 28. Similarly, the circumference of bulbous side 64 is preferably smaller than the circumference of the bulb opening 29 of bay 28 such that weight 60 may pass through bulbous opening 29. In this way, weight 60 can be attached to disk 20 by placing weight 60 in bay 28 and sliding it radially outward such that neck 62 of weight 60 is forced past necked opening 30 and into opening 31 in a snap-fit configuration as shown in FIGS. 3 and 3B. In this way, weight 60 can be readily and removably attached to disk 20. The present invention contemplates providing weights 60 in sets of greater and lesser weight or by providing more than two bays 28 and weights 60. By attaching more or less weight to disk 20, the spinning action of disk 20 changes thereby requiring a different level of resistance and exertion by the user to manipulate device 10. In this way, different levels of exercise can be accomplished.

The present invention also contemplates the optional feature of having one or more optical lights or indicators to reveal to the user the level or rate of spinning of disk 20. For example, commonly known contacts which function based upon centrifugal force could be incorporated into or onto disk 20 such that one or more diodes 82, 84, 86 illuminate when the disk is spinning to indicate the rate of revolutions per minute disk 20 is spinning. It is also contemplated that more than one light diode could be associated with disk 20 to forecast the inertia or resistance to be applied by the user to counteract the spinning of disk 20 and the winding of tethers 40. For example, a red diode 82 could light when the rate of spinning disk 20 is at or near its slowest speed or still state. A yellow diode 84 could light when the disk is spinning at a medium rate and a green diode 86 could illuminate at a higher rate of revolution of disk 20. These embodiments or others are contemplated as visual indicators to the user of the level of resistance or exercise the user is or needs to apply to counteract the spinning disk.

Figure 4:
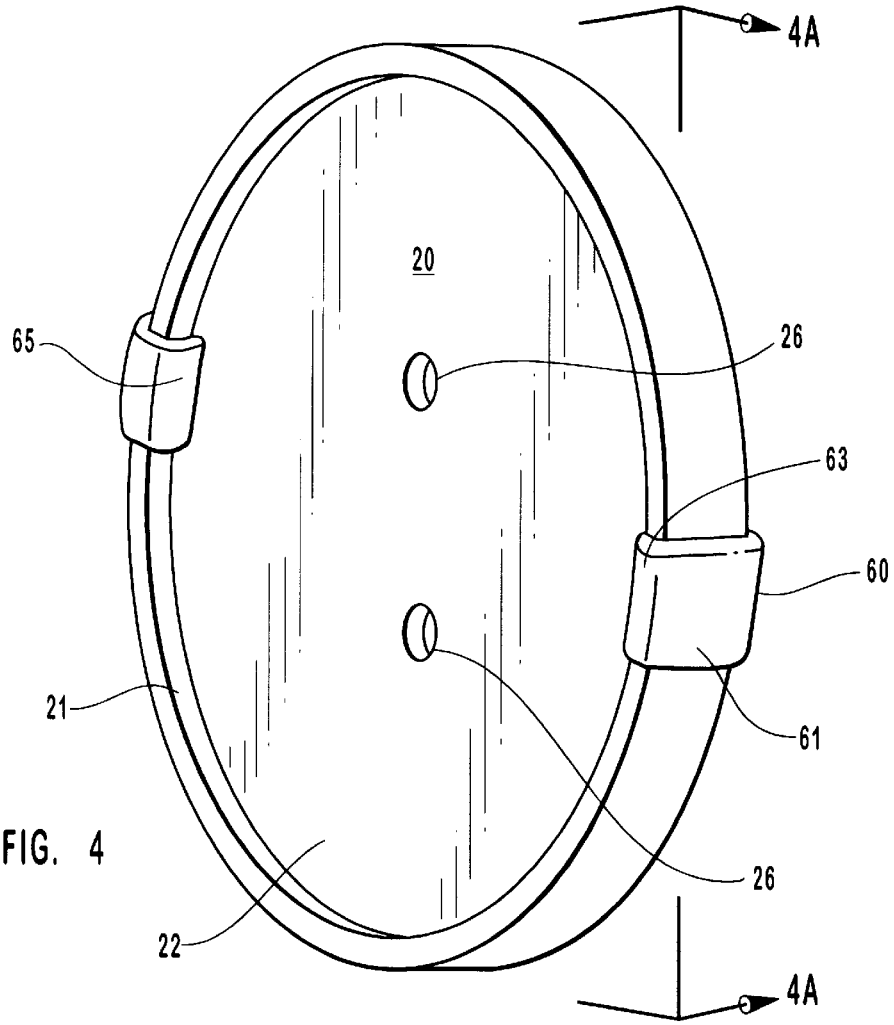
FIG. 4 illustrates a perspective view of an alternative embodiment (weights clipped about the circumference.
Figure 5:
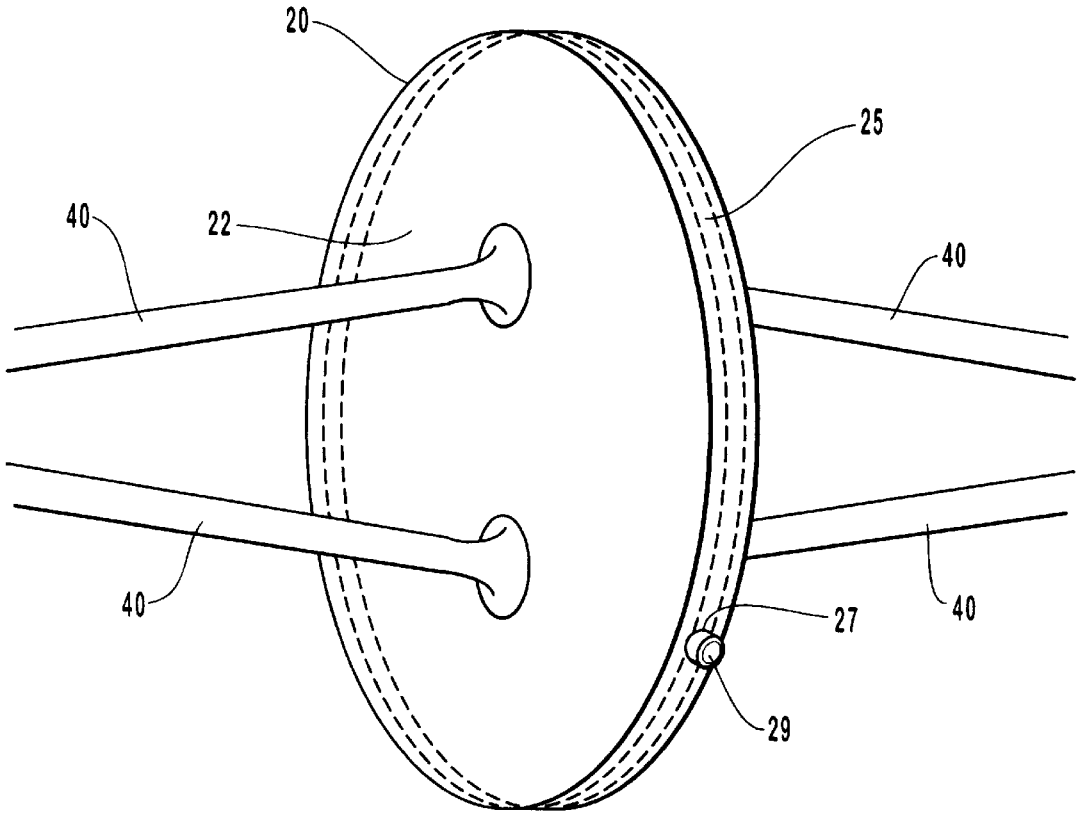
FIG. 5 illustrates another alternative embodiment.

In an alternative embodiment, as illustrated in FIG. 4, disk 20 comprises an annular cuff 21 about the circumference of body 22. Weights 60 are adapted to wrap around cuff 21 having a portion 61 adjacent the outer edge of body 22, a portion 63 adjacent the side of cuff 21 and portion 65 disposed inward of cuff 21. It is contemplated that weight 60 would be of a U-shaped configuration capable of being snapped around cuff 21.

Figure 4A:
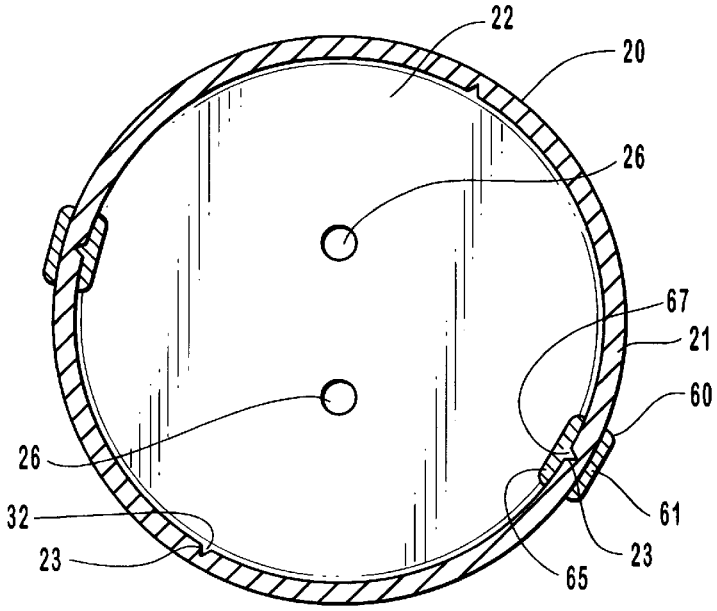
FIG. 4A is a cross-sectional view of FIG. 4 along line A—A.

It is contemplated that weights 60 of FIG. 4 need to be equally spaced about the circumference of body 22 in order to balance spinning. As shown in FIG. 4A, one means for securing and balancing weights 60 about cuff 21 is to provide keyway 32 defined by notched sidewalls 23 in annular cuff 21. A corresponding protrusion 67 in weight portion 65 engages keyway 32 to position weight 60 about the circumference of disk 20. A plurality of keyways 32 could be provided in cuff 21 so as to permit a plurality of weights 60 about disk 20. For example, the keyways could be numbered so as to identify the locations at which a given plurality of weights are to be evenly distributed about the circumference of disk 20. In such an embodiment, rather than adding heavier weights, a greater number of weights could be added and engage corresponding keyways 32 to distribute the weight about disk 20.

In another alternative embodiment shown in FIG. 5, the construction of disk 20 contemplates one or more conduits or caverns 25 in disk 20. Disk body 22 would define an opening 27 in communication with cavern 25. A stop or cap 29 is adapted to seal opening 27 and any contents placed therein. FIG. 5 illustrates an annular cavern 25 which could be filled with water. Other embodiments, not shown, contemplate two or more caverns 25 accessible by two or more openings 27 and occluded by two or more stops 29. The plurality of caverns would not communicate with each other but would be equidistantly spaced radially and circumferentially about the midpoint of disk 20 so as to receive water, sand, or any other suitable compound of material or liquid to increase the weight of disk 20 and thereby increase the characteristics of spin and the resulting inertial resistance needed to be exerted by the user.

Figure 6:
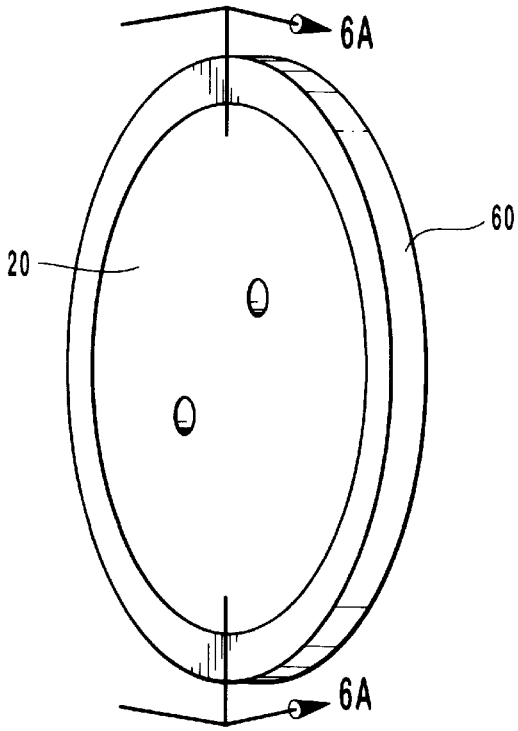
FIGS. 6 and 6A illustrate another alternative embodiment showing an annular weight ring.
Figure 6A:
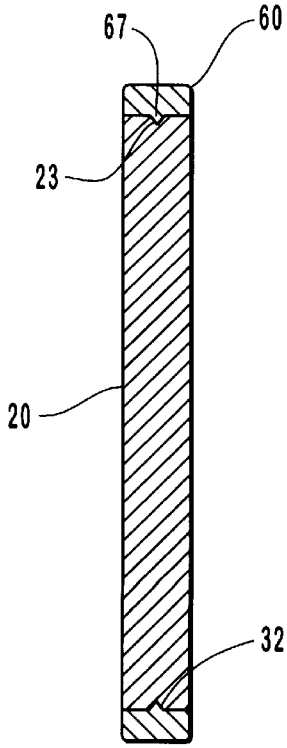

As shown in FIGS. 6 and 6A, an alternative embodiment of disk 20 and weight 60 is illustrated. Disk 20 defines an annular keyway 32 configured by an annular sidewall 23 extending radially inward. Weight 60 is an annular ring along the inside of which is an annular protrusion 67 corresponding to keyway 32 of disk 20. In this embodiment, ring-shaped weight 60 could be disposed about disk 20 in a snapfit configuration.

Figure 7A:
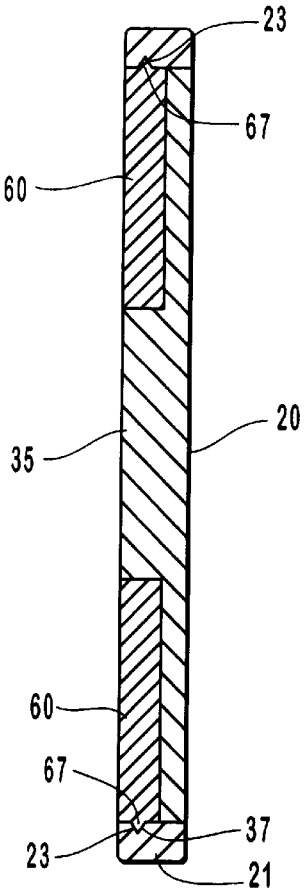
FIGS. 7 and 7A illustrate another alternative embodiment showing a nesting, ring shaped weight.
Figure 7:
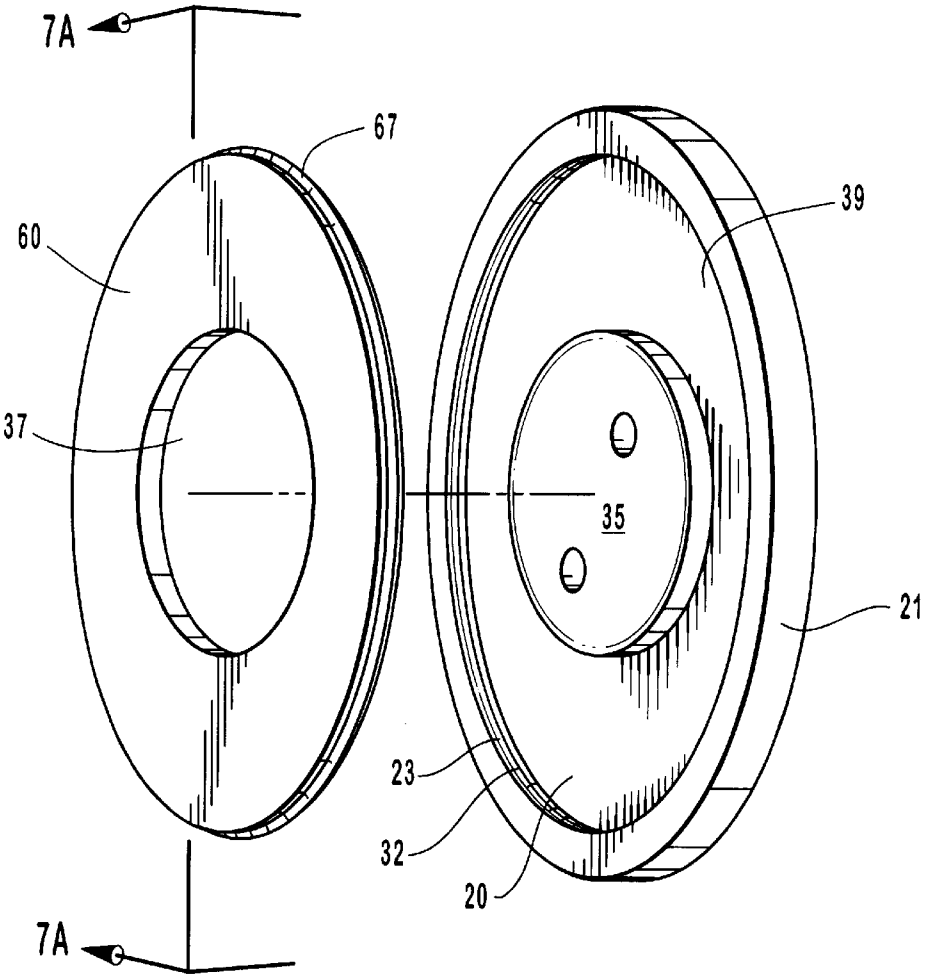

In an alternative embodiment shown in FIGS. 7 and 7A, disk 20 defines a washer or ring-shaped impression 39 on one or both sides of disk body 22. Disk body 22 comprises a cuff 21 and an island 35. On the inward side of cuff 21 is a keyway 32 defined by inwardly extending sidewall 23. A corresponding washer-shaped or ring-shaped weight 60 is adapted to be disposed in impression 39 in a snapfit configuration. For example, weight 60 is configured to have an annular protrusion 67 extending about its circumferential edge. Protrusion 67 of weight 60 corresponds to keyway 32 of disk 20 such that disk 20 receives weight 60 in a snapfit configuration. Ring 60 also defines an opening 37 corresponding to island 35 of disk 20.

Figure 8:
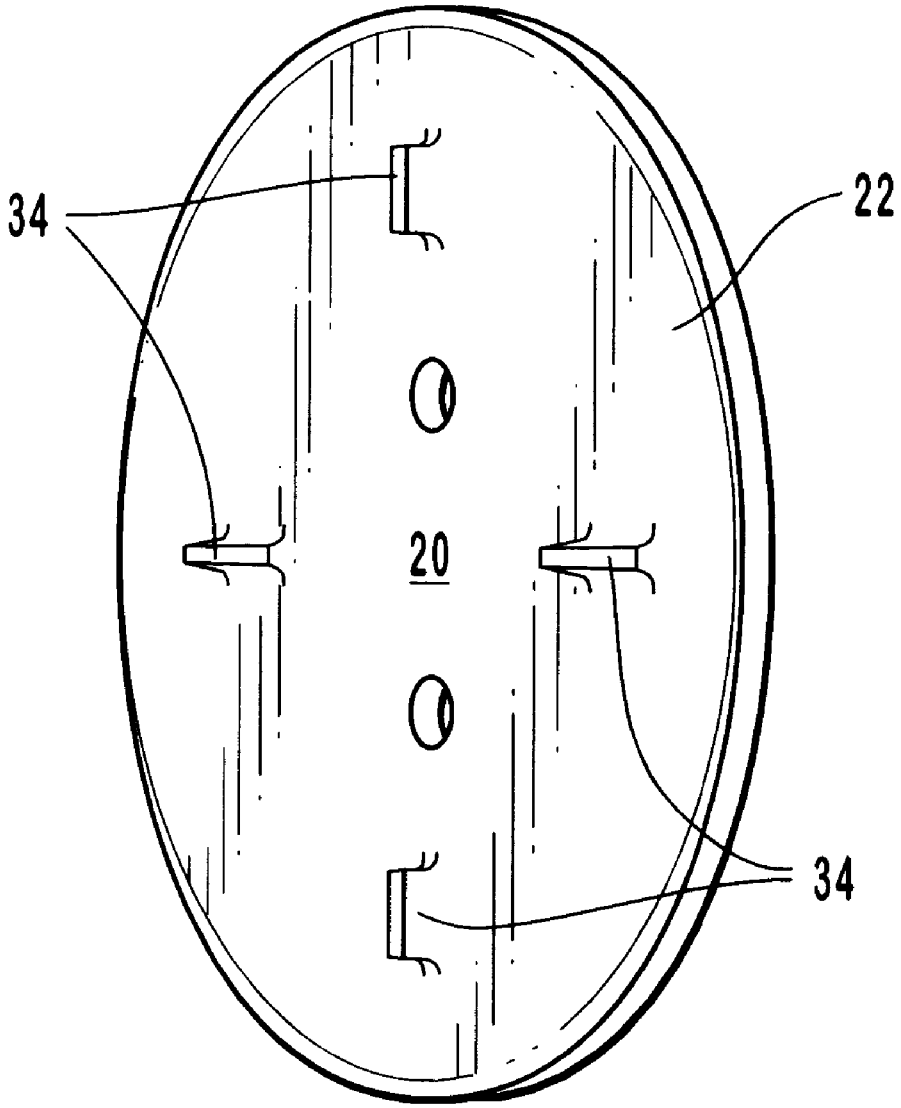
FIG. 8 represents still another embodiment of the present invention.

As shown in FIG. 8, disk 20 may also comprise raised fins or flutes 34. Fins 34 may provide either wind resistance to increase the drag of spinning disk 20 and/or add weight to the disk. Fins 34 may also include openings causing the spinning disk to whistle. The pitch of the whistle may be an audible indicator to the user of the level of exercise being experienced by the user. In an embodiment, not shown, fins 34 with or without any openings could be placed along the outward most or coin edge of body 22.

The exercise device 10 is used in the following fashion. The user grasps the distal end of tethers or optional handles 42, disk 20 is spun several turns in one direction, thereby winding tethers 40. By exerting outward forces away from disk 20, the user accelerates the unwinding of the tethers 40 and the spinning of disk 20 in the opposite direction. During spinning, user relaxes the exertion of outward force and permits disk 20 to unwind the tethers and wind them in the opposite direction. The repeated exertion and relaxing of outward forces winds and unwinds tethers 40 and spins and reverses the spin of disk 20. The handles may be grasped by the user by each hand of the user or one handle may be attached around a foot or other limb or around a stationary device such as a chair or door handle. The repeated exertion of force to wind and unwind the tethers and spin and reverse the spin of the disk provides exercise to muscle groups including the chest, triceps, shoulders, biceps, thighs, waist, stomach, and other muscles depending upon how the device is held by the user or oriented to the user.

In order to increase the exercise experienced by the user, additional weights 60 may be added to the disk 20. The spinning of disk 20 forces repeated repetitions of exertion by the user.

The foregoing descriptions are considered illustrative of the principles of the invention. The present invention may be embodied in other specific forms without departing from its spirit or essential characteristics. It will be appreciated by those of ordinary skill in the art that numerous modifications and changes can be made within the spirit and scope of the present invention and equivalents thereof. The foregoing description is not intended to limit the invention to any exact construction or embodiments or operations shown or illustrated.

The scope of the invention is, therefore, indicated by the appended claims, rather than by the foregoing description.

What is claimed is:

1. An exercise device comprising:

a balanced body;

a plurality of tethers;

means for interfacing the tethers with the body having distal ends adapted to receive a limb of the user or other stationary object; and one or more weights disposed on or about the body, the weights capable of being selectively and readily attached to and removed from the disk.

2. The exercise device of claim 1 wherein the balanced body is a circular, disk-shaped body.

3. The exercise device of claim 1 wherein the distal ends of the tethers further comprise handles adapted for gripping by the user.

4. The exercise device of claim 1 wherein the means for interfacing the tethers with the body comprises a plurality of apertures through which the tethers pass.

5. The invention of claim 1 further comprising lights disposed on or about the body and capable of being activated by centrifugal forces of the body when spinning to show the spinning rate of the body.

6. The exercise device of claim 2 wherein the distal ends of the tethers further comprise handles adapted for gripping by the user.

7. The exercise device of claim 2 wherein the means for interfacing the tethers with the body comprises a plurality of apertures through which the tethers pass.

8. The exercise device of claim 2 further comprising lights disposed on or about the body and capable of being activated by centrifugal forces of the body when spinning to show the spinning rate of the body.

* * * * *